US010779379B2

(12) United States Patent
Peng

(10) Patent No.: US 10,779,379 B2
(45) Date of Patent: Sep. 15, 2020

(54) CARRIER CONTROLLED LIGHT-EMITTING DIODE LIGHT AND LIGHT-EMITTING DIODE LIGHT STRING HAVING THE SAME

(71) Applicant: Semisilicon Technology Corp., New Taipei (TW)

(72) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 0 days.

(21) Appl. No.: 16/266,819

(22) Filed: Feb. 4, 2019

(65) Prior Publication Data

US 2020/0214098 A1 Jul. 2, 2020

(30) Foreign Application Priority Data

Dec. 28, 2018 (CN) ..... 2018 1 1625388

(51) Int. Cl.

| | |
|---|---|
| ***H05B 37/02*** | (2006.01) |
| ***H05B 47/18*** | (2020.01) |
| ***F21V 23/04*** | (2006.01) |
| ***H05B 47/21*** | (2020.01) |
| ***H05B 47/23*** | (2020.01) |
| ***H05B 47/10*** | (2020.01) |

(52) U.S. Cl.

CPC ..... *H05B 47/18* (2020.01); *F21V 23/0435* (2013.01); *H05B 47/10* (2020.01); *H05B 47/21* (2020.01); *H05B 47/22* (2020.01); *H05B 47/23* (2020.01); *H05B 47/235* (2020.01)

(58) Field of Classification Search

CPC ..... H05B 47/10; H05B 47/18; H05B 47/21; H05B 47/22; H05B 47/23; H05B 47/235

USPC ..... 313/307

See application file for complete search history.

(56) References Cited

U.S. PATENT DOCUMENTS 8,928,233 B1 1/2015 Peng
2007/0159422 A1* 7/2007 Blandino ..... A01M 1/2077 345/82

(Continued)

FOREIGN PATENT DOCUMENTS

CN 201521844 U 7/2010
CN 104981048 A 10/2015

(Continued)

OTHER PUBLICATIONS

A Search Report dated May 12, 2020 issued in corresponding European patent Application No. EP19205525 (pp. 11).

*Primary Examiner* — Christopher M Raabe

(74) *Attorney, Agent, or Firm* — Muncy, Geissler, Olds & Lowe, P.C.

(57) ABSTRACT

A carrier-controlled LED light includes at least one LED and a drive unit. The drive unit is coupled to the at least one LED, and receives a carrier light signal to control the at least one LED to proceed to light. The drive unit includes a light control unit and a comparison unit. The light control unit drives a light action of the at least one LED according to a light command content of the carrier light signal. The comparison unit receives a DC working electricity and compares the DC working electricity with a reference voltage value. When a voltage value of the DC working electricity is less than the reference voltage value, the light control unit enters a sleep mode.

13 Claims, 10 Drawing Sheets

(56) References Cited

U.S. PATENT DOCUMENTS

| | | | | |
|---|---|---|---|---|
| 2011/0096099 | A1* | 4/2011 | Yamamoto | H05B 45/22 345/690 |
| 2013/0119876 | A1* | 5/2013 | Shin | H05B 45/46 315/186 |
| 2017/0290120 | A1* | 10/2017 | Peng | H05B 47/19 |
| 2018/0132314 | A1 | 5/2018 | Peng | |

FOREIGN PATENT DOCUMENTS

| | | | |
|---|---|---|---|
| CN | 105472830 | A | 4/2016 |
| CN | 106982489 | A | 7/2017 |
| TW | I611727 | B | 1/2018 |
| WO | WO-2015145287 | A1 | 10/2015 |

* cited by examiner

CARRIER CONTROLLED LIGHT-EMITTING DIODE LIGHT AND LIGHT-EMITTING DIODE LIGHT STRING HAVING THE SAME

BACKGROUND OF THE INVENTION

Field of the Invention

The present invention relates to a light-emitting diode light and a light-emitting diode light string, and especially relates to a carrier-controlled light-emitting diode light and a light-emitting diode light string having the carrier-controlled light-emitting diode light.

Description of the Related Art

Light-emitting diodes (LEDs) are widely applied to the lighting lamps or the decorative lighting (for examples, the Christmas tree lighting, the light special effects of the sneakers, and so on) by the connection methods comprising the series connection, the parallel connection or the series-parallel connection of the light bars or the light strings because the LEDs have the advantages of high luminous efficiency, low power consumption, long life, fast response speed, high reliability, and so on.

The festive light is taken as an example here. Basically, a complete LED lamp of the related art comprises an LED light string (which comprises a plurality of lights) and a related art drive unit for driving the lights. The related art drive unit is electrically connected to the LED light string, and controls the lights by the point-control method or the synchronous method by supplying the required electricity and the control signal which comprises the light data to the lights, to achieve various lighting output effects and changes of the LED lamp.

With the progress of the technology, the related art carrier method can be utilized for the control signal which comprises the light data to carry/transmit the light signal through/on the power line. The related art functions of providing power and data transmission can be achieved by the same circuit structure to simplify the layout design, reduce the volume of the circuit and benefit the design of the control circuit.

The related art drive unit mainly provides a light control signal which comprises a high voltage level and a low voltage level to drive the LED light string. For the drive of the LED light string, usually if the LED light string comprises more of the numbers of the LED lights in series, because the connecting lines connecting the LEDs are thicker and longer, the parasitic capacitive reactance of the LED light string increases, so that the speed of the system processing the signals is not fast enough. Thus, the possibility of determining the light signal incorrectly increases. If effectively avoiding the LED light string interpreting/decoding the light control signal incorrectly is required, the speed of the light control signal at the high voltage and low voltage transition has to slow. However, this results that the number of the lights driven by the LED light string is less and/or the speed of changing lights/colors slows.

FIG. 1 shows a waveform diagram of the light control signal of the related art LED light string. FIG. 1 comprises two light control signal waveforms which are a first waveform Cv1 and a second waveform Cv2 respectively. Moreover, the x-coordinate indicates the time t; the y-coordinate indicates the input voltage Vin; the low-level voltage Vlow and the reset voltage Vreset are indicated as well, wherein the low-level voltage Vlow is the voltage that the light control signal is determined as the low level; the reset voltage Vreset is the voltage that the LEDs are reset. Taking the second waveform Cv2 as an example, the second waveform Cv2 is the natural discharge of the light control signal. Therefore, the existing problem of the second waveform Cv2 is that when the parasite capacitance of the circuit is too high/large, the discharge time is longer, resulting that when entering the next cycle, the second waveform Cv2 still cannot reach the low level voltage Vlow, so that the light control signal cannot be recognized/identified as the low level (namely, the light control signal is continuously determined as the high level voltage). In this case, only increasing the width between two cycles (so the natural discharge is able to reach the low-level voltage Vlow) achieves the recognition/identification of the low-level voltage Vlow. However, such control method is only suitable for less numbers of the lights in series in the LED light string (better control effect can just be achieved). In other words, because rapidly discharging to provide the complete light control signal cannot be achieved, such control method cannot be suitable for more numbers of the lights (for example, over hundreds of the numbers of the lights) in series. Namely, all of the numbers of the lights in series able to receive the complete light control signal cannot be ensured.

Based on this, a related art rapid discharge circuit can be utilized to control the light control signal to rapidly reduce the voltage level of the light control signal, or the LED light string having lesser circuit total parasite capacitance easily reduces the voltage level of the light control signal rapidly, such as the first waveform Cv1 shown in FIG. 1. However, when the light control signal rapidly reduces, the light control signal easily happens that: after the light control signal is lower than the cognizable low level voltage Vlow (for example, at the time t2), the light control signal still rapidly reduces, so that the light control signal touches the reset voltage Vreset (for example, at the time t3), so that the circuit happens unnecessary reset malfunction, resulting in the abnormal determination and malfunction of the LED module.

A related art utilizes a set of signal voltage generation circuit on the control circuit to clamp the voltage, so that the voltage does not reduce to be the reset voltage Vreset. However, eventually the circuits of such related art are complicated. Therefore, the inventor(s) of the present invention would like to provide a simple circuit and overcome and solve the big problem/issue that how to design a carrier controlled LED light and an LED light string having the carrier controlled LED light for solving the voltage of the light control signal touching the reset voltage due to too small parasitic capacitive reactance which results in the abnormal determination and malfunction problems of the LED module.

SUMMARY OF THE INVENTION

An object of the present invention is to provide a carrier-controlled light-emitting diode light to solve the problem that the voltage of the light control signal touches the reset voltage due to rapidly reducing, which results in the abnormal determination and malfunction of the light-emitting diode module.

In order to achieve the object mentioned above, the carrier-controlled light-emitting diode light provided by the present invention comprises at least one light-emitting diode and a drive unit. The drive unit is coupled to the at least one light-emitting diode, and is configured to receive a carrier light signal to control the at least one light-emitting diode to proceed to light. The drive unit includes a light control unit and a comparison unit. The light control unit is configured to drive a light action of the at least one light-emitting diode based on a light command content of the carrier light signal. The comparison unit is configured to receive a direct current working electricity and is configured to compare the direct current working electricity with a reference voltage value. When a voltage value of the direct current working electricity is greater than the reference voltage value, the comparison unit is configured to output a first control signal based on the light command content of the carrier light signal, so that the light control unit is configured to enter a work mode. When the voltage value of the direct current working electricity is less than the reference voltage value, the comparison unit is configured to output a second control signal to the light control unit, so that the light control unit is configured to enter a sleep mode. Moreover, the reference voltage value is greater than a reset voltage value of the drive unit.

In an embodiment, the drive unit further comprises an address signal processing unit. The address signal processing unit is coupled to the light control unit and the comparison unit, and is configured to store a light address. The address signal processing unit is configured to receive an address signal sent from the light control unit to compare the address signal with the light address. When the address signal conforms to the light address (for example but not limited to, the address signal is the same with the light address), the light control unit is configured to drive the at least one light-emitting diode to light based on the light command content of the carrier light signal. When the comparison unit outputs the second control signal to the address signal processing unit, the address signal processing unit is configured to enter the sleep mode until the address signal processing unit receives the first control signal. After the address signal processing unit receives the first control signal, the address signal processing unit is configured to enter the work mode.

In an embodiment, the drive unit further comprises an address burn unit. The address burn unit is coupled to the address signal processing unit and the comparison unit. The carrier light signal comprises a burn start signal and a burn address signal. When the address burn unit receives the burn start signal, the address burn unit is configured to write/burn the light address into the address signal processing unit based on a burn command content of the burn address signal. When the comparison unit outputs the second control signal to the address burn unit, the address burn unit is configured to enter the sleep mode until the address burn unit receives the first control signal. After the address burn unit receives the first control signal, the address burn unit is configured to enter the work mode.

In an embodiment, the drive unit further comprises an oscillator. The oscillator is coupled to the light control unit, the address signal processing unit, the address burn unit and the comparison unit. When the comparison unit outputs the second control signal to the oscillator, the oscillator is configured to enter the sleep mode to stop an oscillating work until the oscillator receives the first control signal. After the oscillator receives the first control signal, the oscillator is configured to enter the work mode to start the oscillating work and to provide an oscillation signal. When the oscillator is in the sleep mode and stops the oscillating work, the light control unit, the address signal processing unit and the address burn unit do not receive (namely, are configured to cease receiving) the oscillation signal provided by the oscillator, so the light control unit, the address signal processing unit and the address burn unit are configured to enter the sleep mode.

In an embodiment, the drive unit further comprises a current detection unit. The current detection unit is coupled to the light control unit. After the light control unit receives the light command content of the carrier light signal through the current detection unit, the light control unit is configured to drive the light action of the at least one light-emitting diode.

In an embodiment, the drive unit further comprises a discharge unit. The discharge unit is coupled to the comparison unit and the current detection unit. When the discharge unit receives the carrier light signal sent by the current detection unit, the discharge unit is configured to start discharging the direct current working electricity.

In an embodiment, the drive unit further comprises a power capacitor. The power capacitor is coupled to the light control unit, the comparison unit and the at least one light-emitting diode.

In an embodiment, the at least one light-emitting diode and the drive unit are arranged on a baseboard with/by a surface mount device (SMD) form. The drive unit and the at least one light-emitting diode are electrically connected (to each other) by a wire bonding method, and are packaged inside a package body.

In an embodiment, the drive unit is electrically connected to and arranged on a first platform. The at least one light-emitting diode is electrically connected to and arranged on a second platform. The drive unit and the at least one light-emitting diode are electrically connected (to each other) by a wire bonding method, and are packaged inside a package body.

With the carrier-controlled light-emitting diode light provided, the power consumption of the analog circuits in the light-emitting diode module can be reduced effectively. Maintaining the light-emitting diode module able to be driven and operate normally can be taken into account at the same time.

Another object of the present invention is to provide a carrier-controlled light-emitting diode light string to simplify the control circuit and solve the problem that the voltage of the light control signal touches the reset voltage due to rapidly reducing, which results in the abnormal determination and malfunction of the light-emitting diode module.

In order to achieve the object mentioned above, the carrier-controlled light-emitting diode light string provided by the present invention comprises a power line, a controller and at least one light-emitting diode light. The controller is coupled to the power line. The at least one light-emitting diode light is coupled to the controller through the power line, and is configured to receive a direct current working electricity and a carrier light signal sent by the controller through the power line.

In an embodiment, the controller comprises a rectification unit, a switch and a control unit. The rectification unit is coupled to the power line, and is configured to provide the direct current working electricity. The switch is connected to the power line and the at least one light-emitting diode light. The control unit is coupled to the rectification unit and the switch. When the control unit controls the switch to be turned on, the direct current working electricity is through the power line to form a power supply circuit (namely, loop) for supplying power to the at least one light-emitting diode light. When the control unit intends to generate the carrier light signal, the control unit is configured to switch a conduction and a cut-off of the switch continuously based on a light command content of the carrier light signal, so that the direct current working electricity of the power line forms a plurality of pulse waves to combine into the carrier light signal, and the carrier light signal is sent to the at least one light-emitting diode light through the power line.

In an embodiment, the controller further comprises a discharge circuit. The discharge circuit is coupled to the power line and the control unit. When the switch is turned off, the controller is configured to drive the discharge circuit to receive the direct current working electricity and to start discharging the direct current working electricity.

In an embodiment, the controller further comprises a voltage adjustment capacitor (namely, a voltage regulation capacitor, or a voltage stabilizing capacitor). The voltage adjustment capacitor is coupled to the power line. When the switch is turned off, the voltage stabilizing capacitor (or the voltage adjustment capacitor) is configured to provide the at least one light-emitting diode light with the direct current working electricity.

With the carrier-controlled light-emitting diode light string provided, the power consumption of the analog circuits in the light-emitting diode module can be reduced effectively. Maintaining the light-emitting diode module able to be driven and operate normally can be taken into account at the same time.

Please refer to the detailed descriptions and figures of the present invention mentioned below for further understanding the technology, method and effect of the present invention achieving the predetermined purposes. It believes that the purposes, characteristic and features of the present invention can be understood deeply and specifically. However, the figures are only for references and descriptions, but the present invention is not limited by the figures.

DETAILED DESCRIPTION OF THE INVENTION

Figure 1:
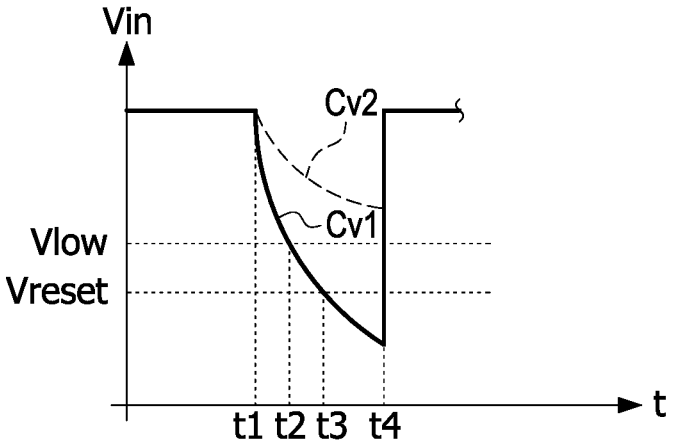
FIG. 1 shows a waveform diagram of the light control signal of the related art LED light string.
Figure 2A:
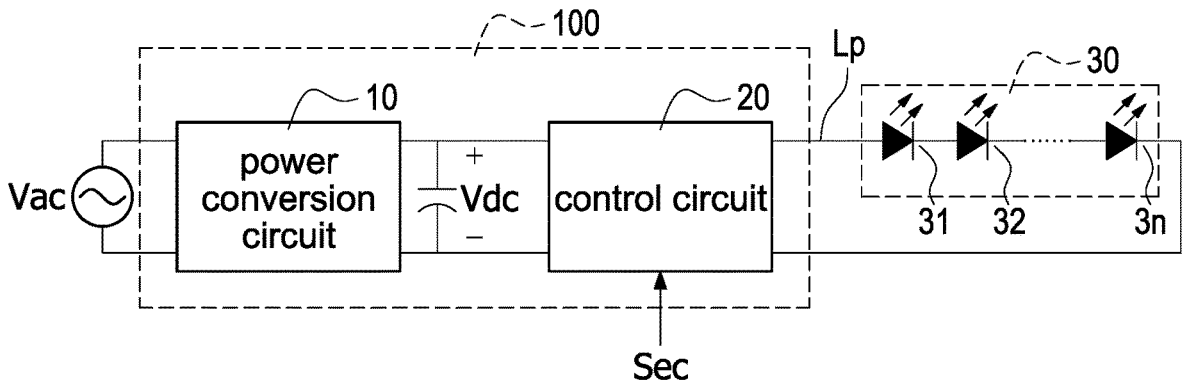
FIG. 2A shows a circuit block diagram of the first embodiment of the drive system of the carrier-controlled light-emitting diode light string of the present invention.

Please refer to the figures for the explanation of the technical content and the detailed description of the present invention:

FIG. 2A shows a circuit block diagram of the first embodiment of the drive system of the carrier-controlled light-emitting diode light string of the present invention. The carrier-controlled light-emitting diode light string can be named as a light-emitting diode light string with carrier control, or can be named as a carrier-control light-emitting diode light string. The drive system of the first embodiment as described comprises a power conversion circuit 10, a control circuit 20 and a light-emitting diode light string 30. Moreover, the power conversion circuit 10 and the control circuit 20 can be integrated as a controller 100. Concretely, the controller 100 can be realized by an entity circuit control box which comprises the conversion circuit 10 and the control circuit 20. The conversion circuit 10 receives an alternating current power Vac, and converts the alternating current power Vac into a direct current power Vdc, wherein the direct current power Vdc can be generated on/by an output capacitor (unlabeled) which is arranged at/across two output sides of the power conversion circuit 10.

The control circuit 20 receives the direct current power Vdc to provide the control circuit 20 and the light-emitting diode light string 30 with required direct current power supply. The controller 100 is coupled to the alternating current power Vac and the light-emitting diode light string 30 through a power line Lp. Broadly speaking, the power line Lp is not limited by the marks in FIG. 2A. As long as any circuit transmits the alternating current power Vac or the direct current power Vdc provided as power, the mentioned circuit belongs to the scope of the power line Lp, for examples, electrical connection places between the alternating current power Vac and the power conversion circuit 10, electrical connection places between the control circuit 20 and the anode side of the light-emitting diode light string 30, or electrical connection places between the control circuit 20 and the cathode side of the light-emitting diode light string 30. In this embodiment, the light-emitting diode light string 30 comprises a plurality of light-emitting diode modules (also known as light-emitting diode lights) 31, 32 . . . 3*n*. The light-emitting diode modules 31, 32 . . . 3*n* are connected in/by series manner (namely, in series), and are electrically connected to the control circuit 20. In this embodiment, the light-emitting diode light string 30 is a light string which has burn functions, so each of the light-emitting diode modules 31, 32 . . . 3*n* respectively comprises digital and analog circuits which burn and process light data and address data, which are described later.

Besides the light data built in the control circuit 20, the control circuit 20 can also receive a light control data Sec from outside by the wired method or the wireless method, so that the control circuit 20 can proceed light control of each of the light-emitting diode modules 31, 32 . . . 3*n* of the light-emitting diode light string 30 based on a content of the light control data Sec. For example, the user can send the light control data Sec to the control circuit 20 by the method of operating a computer and by the wired method, so that the control circuit 20 proceeds light control based on the light control data Sec. Or, the user can send the light control data Sec to the control circuit 20 by the method of operating a cellphone or a wearable device and by the wireless method, so that the control circuit 20 proceeds light control based on the light control data Sec. However, the present invention is not limited by the method sending the light control data Sec mentioned above, and/or not limited by the user device which is operated.

Figure 2B:
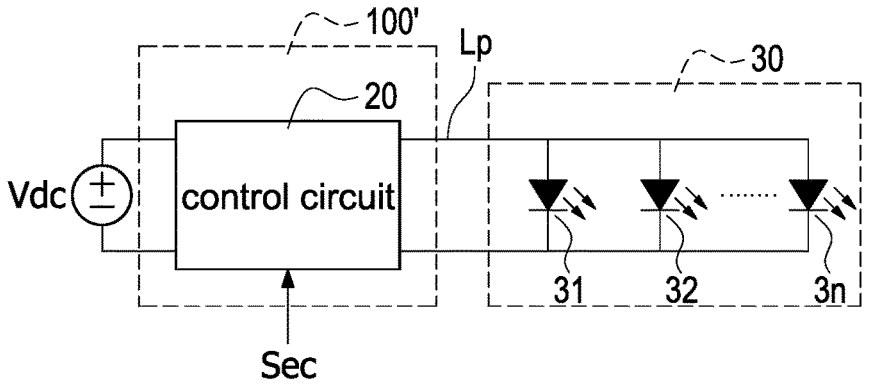
FIG. 2B shows a circuit block diagram of the second embodiment of the drive system of the carrier-controlled light-emitting diode light string of the present invention.

FIG. 2B shows a circuit block diagram of the second embodiment of the drive system of the carrier-controlled light-emitting diode light string of the present invention. The main difference between the second embodiment of FIG. 2B and the first embodiment of FIG. 2A is that the light-emitting diode modules 31, 32 . . . 3*n* of the light-emitting diode light string 30 of the former (namely, the second embodiment of FIG. 2B) are connected in parallel manner, and are electrically connected to the control circuit 20. In the embodiment, because the light-emitting diode modules 31, 32 . . . 3*n* are connected in parallel manner, the control circuit 20 and the light-emitting diode modules 31, 32 . . . 3*n* are directly supplied power by a direct current power Vdc, which is for example but not limited to, a battery unit. In other words, compared to the first embodiment of FIG. 2A, the second embodiment of FIG. 2B saves/omits the operation of converting the alternating current power Vac into the direct current power Vdc by the power conversion circuit 10. Similarly, the light-emitting diode light string 30 is a light string which has burn functions, so each of the light-emitting diode modules 31, 32 . . . 3*n* respectively comprises digital and analog circuits which burn and process light data and address data, which are described later.

Figure 3A:
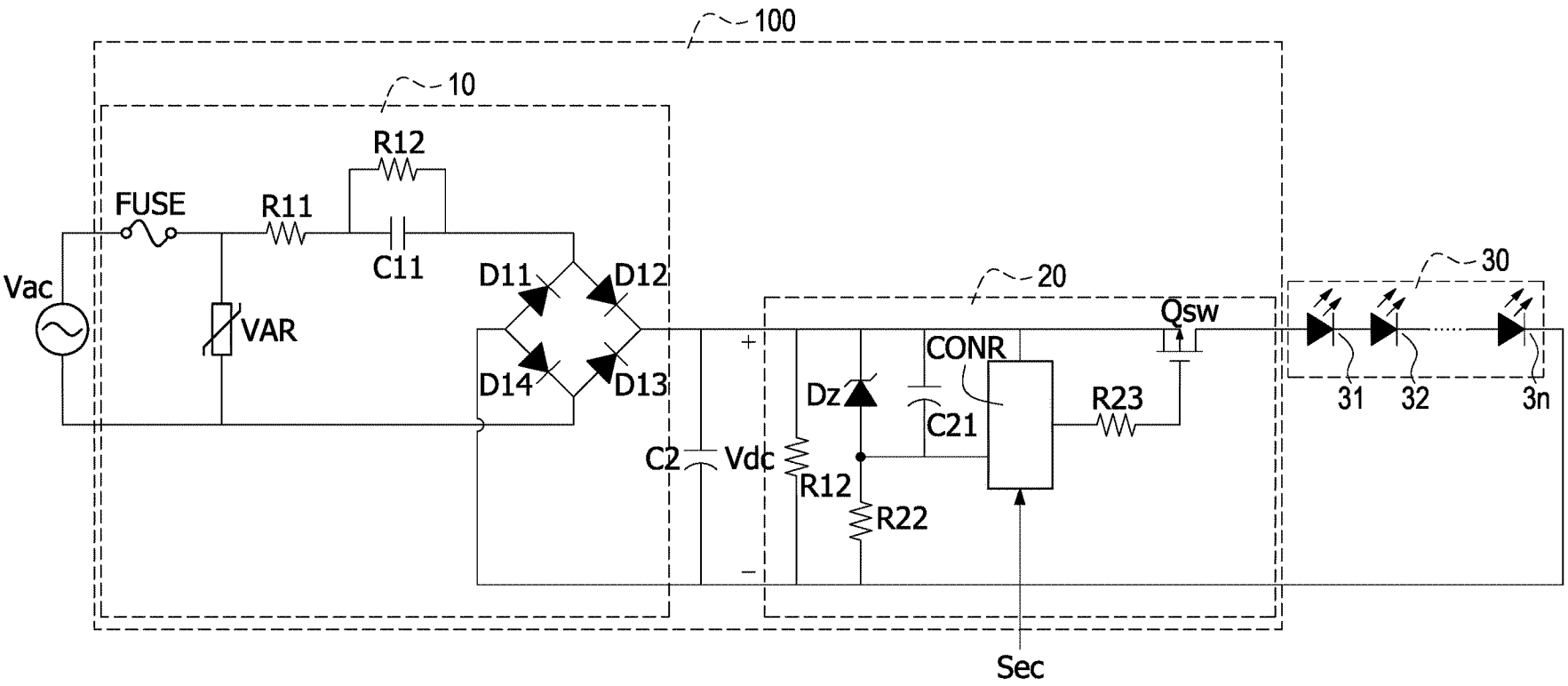
FIG. 3A shows a detailed circuit diagram of an embodiment of the power conversion circuit and the control circuit in FIG. 2A.
Figure 3B:
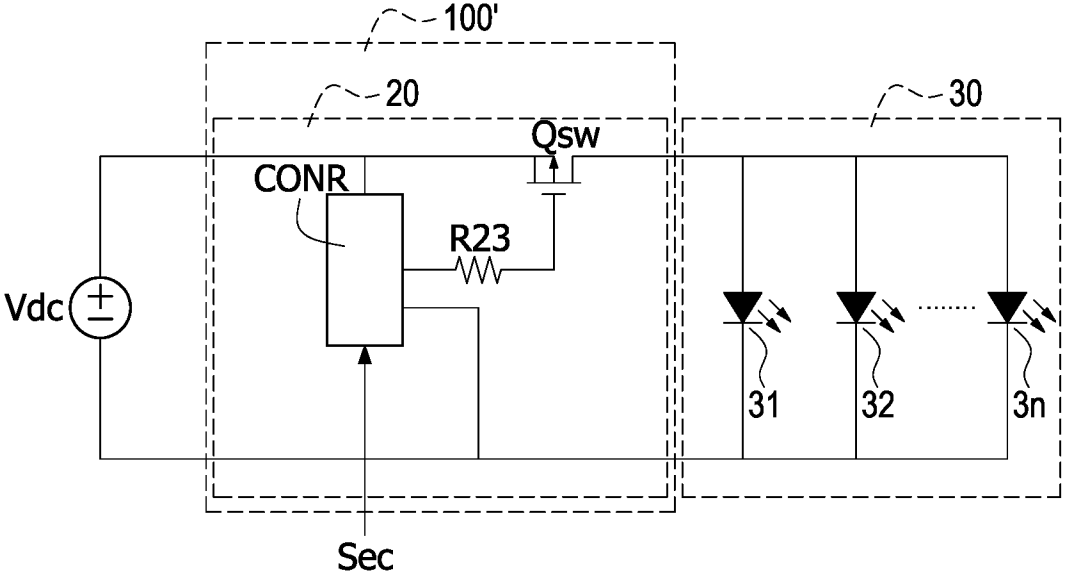
FIG. 3B shows a detailed circuit diagram of the power conversion circuit and the control circuit in FIG. 2B.

FIG. 3A shows a detailed circuit diagram of an embodiment of the power conversion circuit and the control circuit in FIG. 2A. FIG. 3B shows a detailed circuit diagram of the power conversion circuit and the control circuit in FIG. 2B. The power conversion circuit 10 comprises a fuse FUSE, a varistor VAR, an input resistor R12, an input capacitor C11 which is connected to the input resistor R12 in parallel, and a full-bridge rectifier which is composed of a plurality of diodes D11~D14. The fuse FUSE and the varistor VAR provide the power conversion circuit 10 with the overcurrent protection and the overvoltage protection respectively. The input resistor R12 and the input capacitor C11 are coupled between the fuse FUSE, the varistor VAR and the full-bridge rectifier. Redundant energy is absorbed by the input capacitor C11, so that the total voltage magnitude supplied to the light-emitting diode light string 30 is adjusted. After the alternating current power Vac is rectified by the full-bridge rectifier, the full-bridge rectifier outputs the direct current power Vdc to an output capacitor C2 which is arranged across/on two output sides of the power conversion circuit 10.

The control circuit 20 comprises a control unit CONR, an output control switch Qsw and a working voltage generation circuit (which is for the control unit CONR). The control unit CONR is coupled to the output control switch Qsw and the working voltage generation circuit. The output control switch Qsw receives the direct current power Vdc and is controlled by the control unit CONR to conduct or cut off the direct current power Vdc sent to the light-emitting diode light string 30. Namely, if the output control switch Qsw is turned on, the Vdc is sent to the light-emitting diode light string 30; if the output control switch Qsw is turned off, the Vdc is not sent to the light-emitting diode light string 30. In the embodiment, the output control switch Qsw is coupled to the anode side of the light-emitting diode light string 30, and is a p-channel MOSFET, and is coupled to the control unit CONR through the resistor R23. However, in other embodiments, the output control switch Qsw can be coupled to the cathode side of the light-emitting diode light string 30 as well, and is an n-channel MOSFET, and is coupled to the control unit CONR through the resistor R23, which can achieve circuit equivalent characteristics.

In the embodiment, the working voltage generation circuit (which is for the control unit CONR) comprises a resistor R22, a capacitor C21 and a Zener diode Dz. The capacitor C21 and the Zener diode Dz are connected in parallel, and then the circuit which comprises the capacitor C21 and the Zener diode Dz is connected to the resistor R22, but the present invention is not limited by the components and/or connections mentioned above. The Zener diode Dz receives the direct current power Vdc through the resistor R22, and clamps the direct current power Vdc in/at a predetermined fixed voltage value, to provide the control unit CONR with the required working voltage. However, the present invention is not limited by the structure of the working voltage generation circuit (which is for the control unit CONR) shown in FIG. 3A.

Figure 3C:
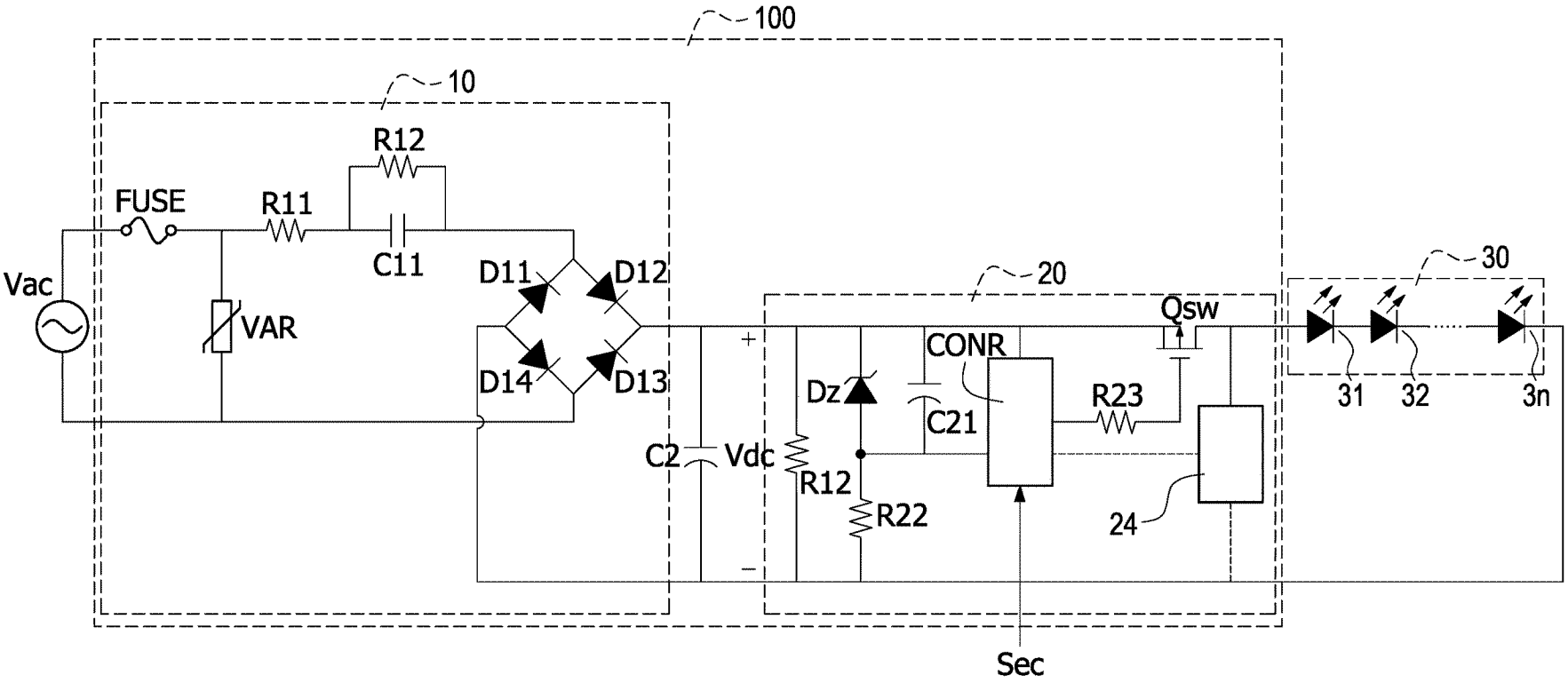
FIG. 3C shows a detailed circuit diagram of another embodiment of the power conversion circuit and the control circuit in FIG. 2A.

Please refer to FIG. 3C as well. FIG. 3C shows a detailed circuit diagram of another embodiment of the power conversion circuit and the control circuit in FIG. 2A. Compared to FIG. 3A, the control circuit 20 further comprises a voltage adjustment unit 24. The voltage adjustment unit 24 can be a rapid discharge circuit which is used to adjust (namely, rapidly discharge) the direct current working electricity which is supplied to the light-emitting diode light string 30. Or, the voltage adjustment unit 24 can be a voltage adjustment capacitor which is used to adjust (namely, slowly discharge) the direct current working electricity which is supplied to the light-emitting diode light string 30.

If the voltage adjustment unit 24 is the voltage adjustment capacitor, the voltage adjustment unit 24 is coupled to two sides of the light-emitting diode light string 30 in parallel, and slowly discharges the direct current working electricity which is supplied to the light-emitting diode light string 30 based on the magnitude of the capacitance value (capacitive reactance value) provided by the voltage adjustment capacitor.

If the voltage adjustment unit 24 is the rapid discharge circuit, the voltage adjustment unit 24 is coupled to the output control switch Qsw, the light-emitting diode light string 30 and the control unit CONR, and is controlled by the control unit CONR. When the control unit CONR controls the output control switch Qsw to be turned off, the control unit CONR reduces the voltage outputted to the light-emitting diode light string 30 (also known as the output voltage) by the discharge method, or controls the rapid discharge circuit (namely, the voltage adjustment unit 24), or controls the rapid discharge circuit (not shown in FIG. 3C) inside each of the light-emitting diode modules 31, 32 . . . 3*n*, to rapidly reduce the voltage of the direct current working electricity outputted to the light-emitting diode light string 30. The control unit CONR turns on the output control switch Qsw to recover (increase) the output voltage outputted to the light-emitting diode light string 30 based on the predetermined time, and generates a light drive signal based on the light control data Sec received by the control unit CONR, so that the light-emitting diode light string 30 proceeds the operation of the light mode based on the light drive signal.

Conversely, when the light drive signal is not required to be sent to the light-emitting diode light string 30, the control unit CONR controls the output control switch Qsw to be turned on, so that the direct current power Vdc (namely, the direct current working electricity) outputted by the power conversion circuit 10 supplies power to the light-emitting diode light string 30 through the output control switch Qsw. Therefore, the efficiency that both the light drive signal and the supplied power can be sent to the light-emitting diode light string 30 under/with/by the same circuit structure can be achieved by as long as the output control switch Qsw is controlled to be turned off or turned on.

Figure 4A:
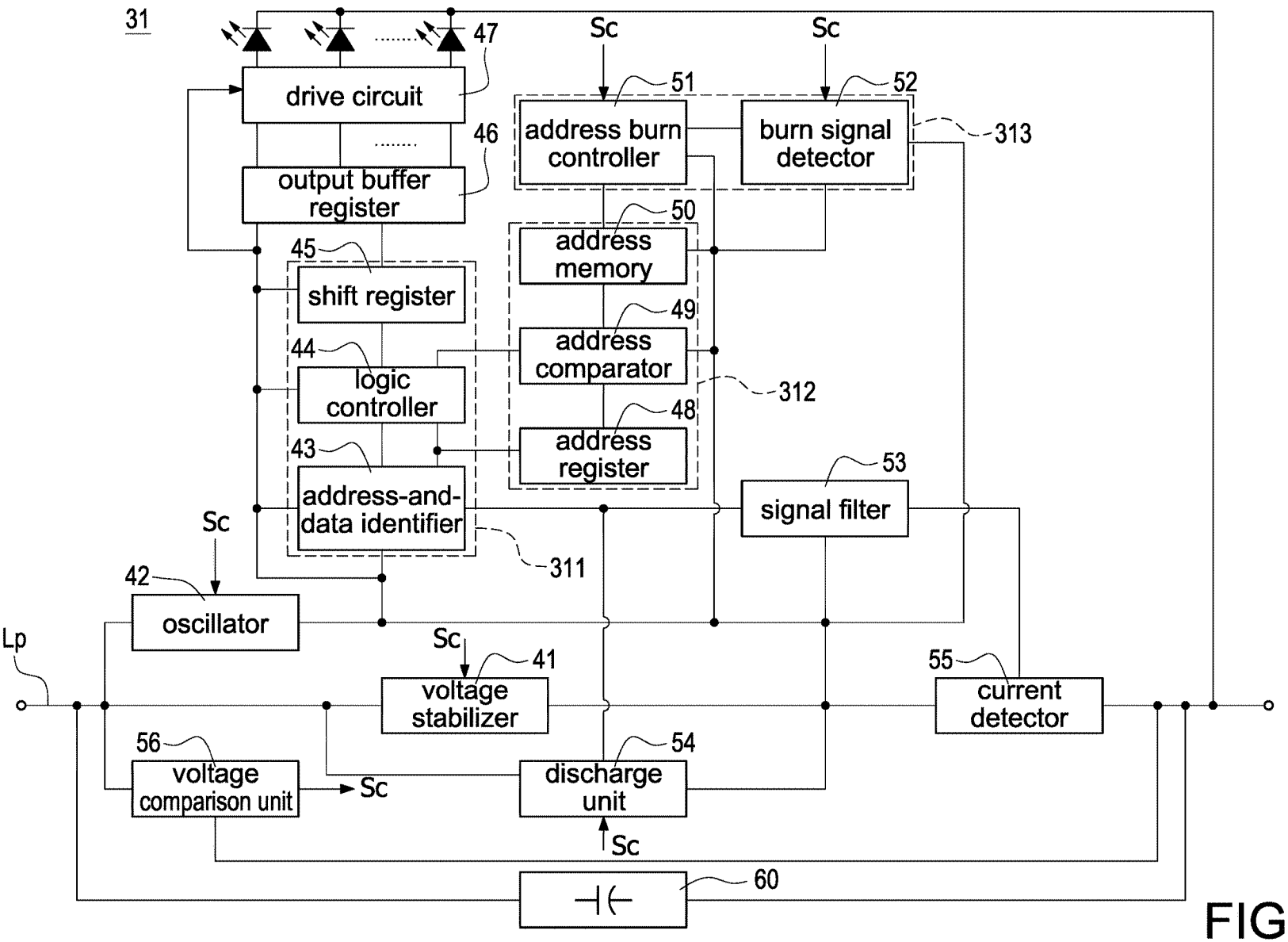
FIG. 4A shows a circuit block diagram of the first embodiment of the light-emitting diode module of the present invention.

FIG. 4A shows a circuit block diagram of the first embodiment of the light-emitting diode module of the present invention. Continuing from the contents mentioned above, the light-emitting diode light string 30 is a light string which has burn functions, so each of the light-emitting diode modules 31, 32 . . . 3*n* respectively comprises digital and analog circuits which burn and process the light data and the address data, for example, a light control unit 311 which is in charge of light control, an address signal processing unit 312 which is in charge of address signal processing, and an address burn unit 313 which is in charge of burning the address. Taking the light-emitting diode module 31 with the burn function shown in FIG. 4A as an example, the light-emitting diode module 31 (namely, the light-emitting diode light) comprises a voltage stabilizer 41 (namely, voltage regulator), an oscillator 42, an address-and-data identifier 43 (namely, address-and-data recognizer), a logic controller 44, a shift register 45, an output buffer register 46, a drive circuit 47, an address register 48, an address comparator 49, an address memory 50, an address burn controller 51, a burn signal detector 52, a signal filter 53, a discharge unit 54, a current detector 55 and a voltage comparison unit 56. Each of the other light-emitting diode modules 32 . . . 3*n* comprises the same circuit blocks mentioned above, and thus is not described here for brevity.

Moreover, the discharge unit 54 can achieve the discharging function by a conduction control and a cut-off control of a power switch. The current detector 55 can be a voltage-dividing resistor network which correspondingly achieves the detection of the current magnitude by the voltage value which is obtained by dividing the received voltage. Incidentally, the light control unit 311 comprises the address-and-data identifier 43, the logic controller 44 and the shift register 45 mentioned above. The light control unit 311 is used to drive a light action of the light-emitting diode based on the light command content of the carrier light signal. Moreover, the light command content is corresponding to the light action (method/pattern) of the light-emitting diode, for example, color changes, on-off (bright-dark) pattern, on-off frequency, specific recognized/discriminated/identifiable encoded contents, and so on. The address signal processing unit 312 comprises the address register 48, the address comparator 49 and the address memory 50 mentioned above. The address burn unit 313 comprises the address burn controller 51 and the burn signal detector 52 mentioned above.

Incidentally, the light-emitting diode module shown in FIG. 4A is applied to the serial connection pattern shown in FIG. 2A and FIG. 3A, so that the voltage stabilizer 41 is required to be used for voltage regulating/adjusting and voltage stabilizing. Moreover, the light-emitting diode module shown in FIG. 4A utilizes the point-control operating method, so that the light-emitting diode module comprises the address signal processing unit 312 and the address burn unit 313 which process (including determine, store, burn operation, and so on) the address data. Namely, the light-emitting diode module shown in FIG. 4A comprises the address signal processing unit 312 and the address burn unit 313 which comprise the address register 48, the address comparator 49, the address memory 50, the address burn controller 51 and the burn signal detector 52. In other words, if the light-emitting diode module utilizes the synchronous operation method, the address signal processing unit 312 and the address burn unit 313 can be omitted, and only the light control unit 311 for processing the light data is required.

In the circuits mentioned above, the circuits can be divided into an analog circuit part and a digital circuit part based on the differences of the signal characteristic/property. Moreover, the voltage stabilizer 41, the oscillator 42, the address burn controller 51, the burn signal detector 52 and the discharge unit 54 belong to the analog circuit part. The others belong to the digital circuit part. However, in different embodiments, the address burn controller 51 and the burn signal detector 52 can also be achieved by both the analog circuits and the digital circuits. Relative to the low power consumption feature of the digital circuits, the analog circuits (for examples, the voltage stabilizer 41, the oscillator 42, the light control unit 311, the address signal processing unit 312, the address burn unit 313, and the discharge unit 54) belong to the circuit components (in the light-emitting diode module 31) that have higher power consumption. Therefore, the creative feature of the present invention is to put particular emphasis on effectively reducing the power consumption of the analog circuits; maintaining the light-emitting diode module 31 to be able to be driven and operated normally can be taken into account at the same time. Descriptions are as follows.

The voltage stabilizer 41 receives an input voltage, and provides the input voltage with voltage regulation/adjustment and control (namely, regulating/adjusting and controlling the input voltage), so that the output voltage which is supplied maintains stability. The oscillator 42 generates periodic clock signals which are used as the time reference (time base) to maintain the light control unit 311, the address signal processing unit 312 and the address burn unit 313 to be able to operate normally and orderly. Therefore, when the oscillator 42 enters a sleep mode to cease/stop an oscillating work, the light control unit 311, the address signal processing unit 312 and the address burn unit 313 are controlled to enter the sleep mode.

The address-and-data identifier 43 is coupled to the oscillator 42. The logic controller 44 is coupled to the address-and-data identifier 43. The shift register 45 is coupled to the logic controller 44. The output buffer register 46 is coupled to the shift register 45, and is coupled to the drive circuit 47. The drive circuit 47 is coupled to a plurality of light-emitting diodes.

The address register 48 is coupled to the logic controller 44. The address comparator 49 is coupled to the logic controller 44 and the address register 48. The address memory 50 is coupled to the address comparator 49. The address burn controller 51 is coupled to the address memory 50. The burn signal detector 52 is coupled to the address memory 50 and the address burn controller 51. The signal filter 53 is coupled to the address-and-data identifier 43, the voltage stabilizer 41 and the oscillator 42.

The light drive signal generated by the control circuit 20 is sent to the light-emitting diode module 31, and is supplied to the address-and-data identifier 43 for identifying after being filtered by the signal filter 53. After identifying, the address-and-data identifier 43 identifies/recognizes the address data (information) and the light data (information) in the light drive signal respectively. The address-and-data identifier 43 sends the address data and the light data to the logic controller 44. The logic controller 44 sends the address data to the address register 48. However, the present invention is not limited by it. The address data can also be sent to the address register 48 by the address-and-data identifier 43 after being identified by the address-and-data identifier 43.

The address comparator 49 receives the address data of the address register 48, and also receives a local address data stored in the address memory 50 at the same time, and then compares the address data with the local address data. If the address data is the same with the local address data, it means that the light data received by the logic controller 44 currently is the light control data of the light-emitting diode module 31. At this time, the address comparator 49 informs the logic controller 44 to send the light data to the drive circuit 47 through the shift register 45 and the output buffer register 46 to provide the use of driving the light-emitting diodes. Conversely, if the address data is different from the local address data, it means that the light data received by the logic controller 44 currently is not the light control data of the light-emitting diode module 31 but is the light control data of one of the other light-emitting diode modules 32 . . . 3*n*.

When the burn signal detector 52 detects the burn start signal, the burn signal detector 52 informs the address burn controller 51 that the burn signal detector 52 detects the burn start signal. At this time, the address burn controller 51 starts receiving a burn address data, and burns the burn address data into the address memory 50, so that the address memory 50 stores the local address data.

Figure 4B:
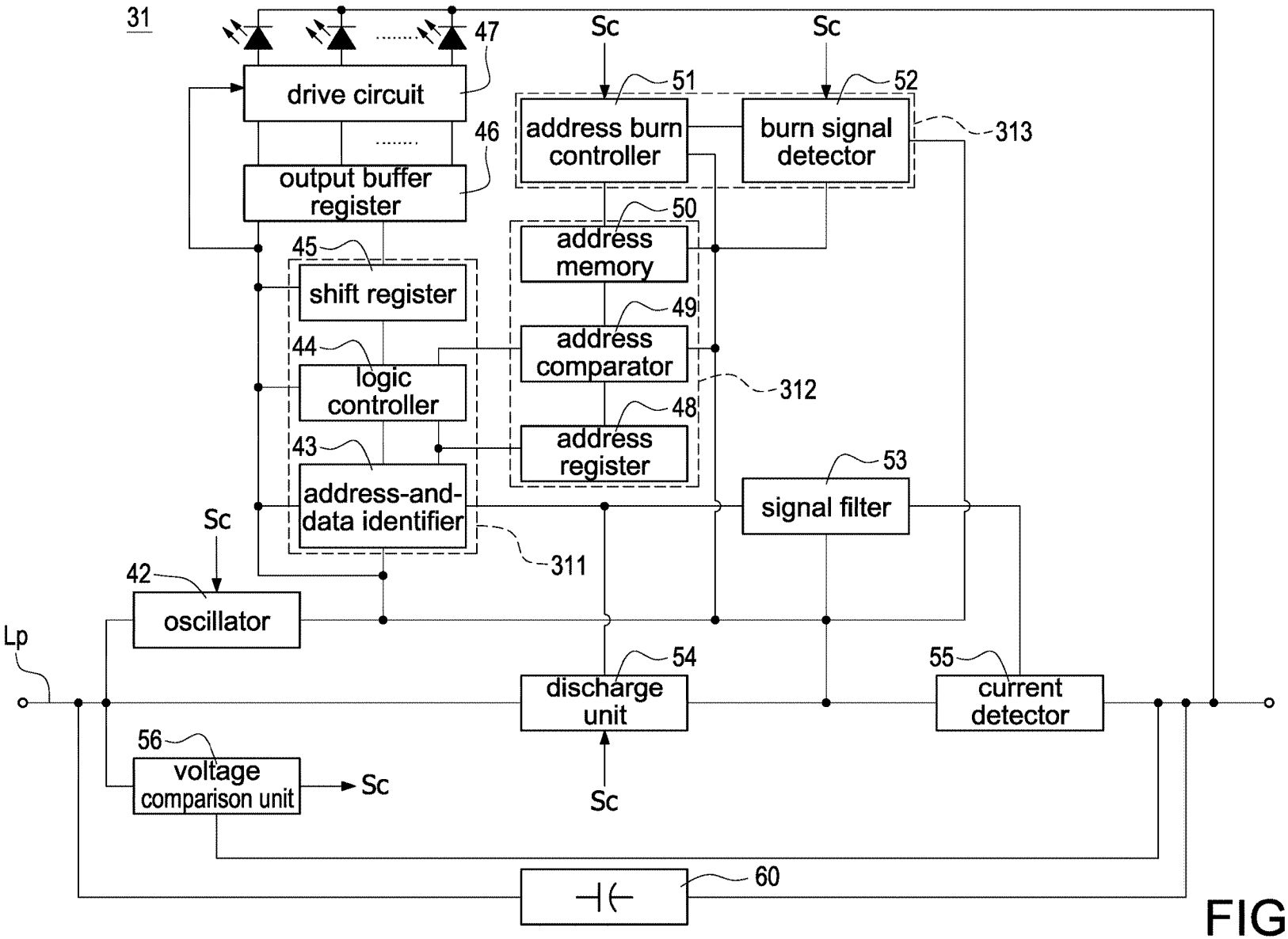
FIG. 4B shows a circuit block diagram of the second embodiment of the light-emitting diode module of the present invention.

FIG. 4B shows a circuit block diagram of the second embodiment of the light-emitting diode module of the present invention. Continuing from the contents mentioned above, because the light-emitting diode module shown in FIG. 4B is applied to the parallel connection pattern shown in FIG. 2B and FIG. 3B, the main difference between the second embodiment of FIG. 4B and the first embodiment of FIG. 4A is that no extra voltage stabilizer 41 is required to be used for voltage regulating/adjusting and voltage stabilizing for the former (namely, the second embodiment of FIG. 4B). The other circuit operating principles and actions are the same with the contents recorded/mentioned for FIG. 4A, and are omitted here for brevity.

Figure 5:
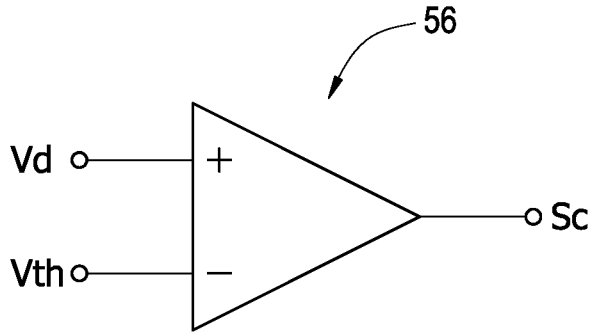
FIG. 5 shows a circuit diagram of the voltage comparison unit of the present invention.

Continuing from the contents mentioned above, in order to achieve effectively reducing the power consumption of the analog circuits, and in order to maintain the normal operation of the light-emitting diode module 31 at the same time, the light-emitting diode module 31 further comprises a comparison unit, for example, a voltage comparison unit 56 which is used to compare voltages. Taking the light drive signal to be the voltage signal as an example, the voltage comparison unit 56 receives the light drive signal Vd and a reference voltage value Vth which is predetermined, as shown in FIG. 5. FIG. 5 shows a circuit diagram of the voltage comparison unit of the present invention. In this embodiment, an operation amplifier circuit used as a comparator can achieve the voltage comparison unit 56, wherein the light drive signal Vd received by the voltage comparison unit 56 inputs to (namely, is received by) a non-inverting input end of the comparator, and the reference voltage value Vth inputs to (namely, is received by) an inverting input end of the comparator. By comparing the light drive signal Vd with the reference voltage value Vth, when the light drive signal Vd is greater than the reference voltage value Vth, the voltage comparison unit 56 outputs a high-level control signal Sc. Conversely, when the light drive signal Vd is less than the reference voltage value Vth, the voltage comparison unit 56 outputs a low-level control signal Sc. However, the present invention is not limited by it. The light drive signal Vd and the reference voltage value Vth can input to (namely, be received by) the inverting input end and the non-inverting input end of the comparator respectively; after comparing, the control signal Sc with reverse level mentioned above can be obtained; the determination for the light drive signal Vd can be achieved as well. Besides, for the determination of the light drive signal Vd, the present invention is not limited by using the operation amplifier circuit to achieve the determination of the light drive signal Vd; any circuit which is able to be used to compare voltages should be included in the scope of the present invention.

Figure 6:
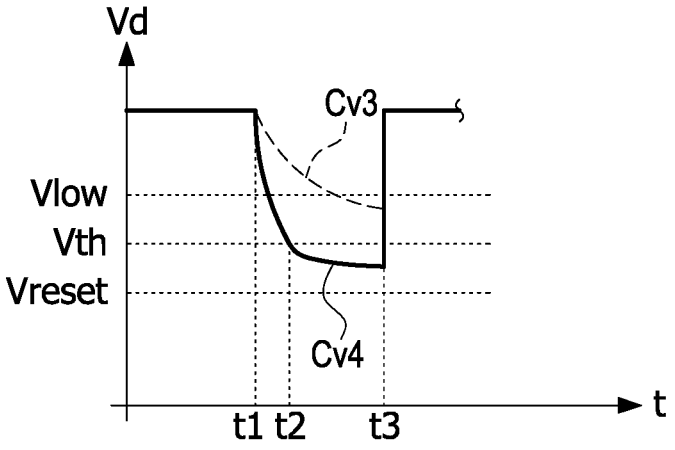
FIG. 6 shows a waveform diagram of the light drive signal of the present invention.

FIG. 6 shows a waveform diagram of the light drive signal of the present invention. Continuing from the contents mentioned above, when the control unit CONR controls the output control switch Qsw to be turned off, the light-emitting diode light string 30 reduces the voltage by the discharge method, to supply the low-level voltage of the light drive signal Vd for driving each of the light-emitting diode modules 31, 32 . . . 3*n* of the light-emitting diode light string 30. Or, the rapid discharge circuit inside each of the light-emitting diode modules 31, 32 . . . 3*n* is controlled to rapidly reduce the voltage generated by the light signal voltage generation circuit, to supply the low-level voltage of the light drive signal Vd for driving each of the light-emitting diode modules 31, 32 . . . 3*n* of the light-emitting diode light string 30. Moreover, by the voltage comparison unit 56 comparing the light drive signal Vd with the reference voltage value Vth, the light drive signal Vd rapidly reducing to touch the reset voltage Vreset due to rapid discharge operation can be solved, wherein the light drive signal Vd rapidly reducing to touch the reset voltage Vreset results that the circuit happens unnecessary reset malfunction, resulting in abnormal determination and malfunction of the light-emitting diode module 31.

Concretely, as a fourth waveform Cv4 shows, at a time t1, the control unit CONR controls the output control switch Qsw to be turned off; at this time, the light drive signal Vd reduces rapidly. At a time t2, when the light drive signal Vd reaches the reference voltage value Vth, because the light drive signal Vd is less than (could be also less than or equal to) the reference voltage value Vth, after the voltage comparison unit 56 shown in FIG. 5 compares the two voltages (namely, compares the light drive signal Vd with the reference voltage value Vth), the voltage comparison unit 56 outputs the low level control signal Sc. At this time, in order to prevent the light drive signal Vd from further reducing rapidly due to the rapid discharge, the control signal Sc generated by the voltage comparison unit 56 controls the power consumption higher circuits of the light-emitting diode module 31, for example but not limited to, the analog circuits, such as the voltage stabilizer 41, the oscillator 42, the light control unit 311, the address signal processing unit 312, the address burn unit 313, and the discharge unit 54 shown in FIG. 4A, to enter the sleep mode (or can be named as the eco mode) to reduce the power consumption of the light-emitting diode module 31 significantly/greatly, so that the reducing speed of the light drive signal Vd decreases significantly/greatly (namely, the reducing speed of the light drive signal Vd becomes much mitigating, and the light drive signal Vd becomes much more even). Incidentally, in order to simplify the contents of FIG. 4A and FIG. 4B, the control signals Sc inputting to the voltage stabilizer 41, the oscillator 42, the address burn controller 51, the burn signal detector 52, and the discharge unit 54 are actually from the voltage comparison unit 56 coupled to the voltage stabilizer 41, the oscillator 42, the address burn controller 51, the burn signal detector 52, and the discharge unit 54 respectively. The voltage comparison unit 56 supplies/outputs the control signals Sc to the circuit units.

After the time t2 shown in FIG. 6, when the light drive signal Vd is less than the reference voltage value Vth, because the analog circuits mentioned above enter the sleep mode, the fading/falling speed of the light drive signal Vd is slow down to avoid touching the reset voltage Vreset. Incidentally, rapid discharge detection, reducing power consumption effectively, and correctly determining (identifying/recognizing) the low level voltage of the light drive signal Vd can be achieved by designing that the low level voltage for identifying/recognizing the light drive signal Vd is the reference voltage value Vth, or is slightly less than the reference voltage value Vth (but is greater than the voltage value of the reset voltage Vreset), so that the light-emitting diode module 31 can be driven normally and can operate normally. For example, the reset voltage Vreset can be designed as 0.7 volt, the reference voltage value Vth can be designed as 1.1 volts, and the low-level voltage of the light drive signal Vd can be designed as 1.1 volts (or smaller/lower 0.8~1.0 volt). Cooperating with the requirement of the response or the action of the whole circuit, the present invention can properly design and adjust the reset voltage Vreset, the reference voltage value Vth and the low-level voltage of the light drive signal Vd.

Until a time t3, the control unit CONR turns on the output control switch Qsw to recover (increase) the output voltage outputted to the light-emitting diode light string 30, and generates the light drive signal based on the light control data Sec received by the control unit CONR, so that the light-emitting diode light string 30 proceeds the operation of the light mode based on the light drive signal. Therefore, because the light drive signal Vd is greater than the reference voltage value Vth, the control signals Sc generated by the voltage comparison unit 56 are switched/converted/changed from the low level to the high level, so that the control signals Sc control the voltage stabilizer 41, the oscillator 42, the light control unit 311, the address signal processing unit 312, the address burn unit 313 and the discharge unit 54 to leave from the sleep mode, to recover the normal operations of the circuit units. Similarly, the other light-emitting diode modules 32 . . . 3*n* are supplied controls (namely, are controlled) by the subsequent cycles of the light drive signal Vd. Similar operations are not repeated here for brevity. Therefore, the drives and the light controls of all of the light-emitting diode modules 31, 32 . . . 3*n* of the light-emitting diode light string 30 are accomplished.

Besides the embodiments and the methods mentioned above, referring to FIG. 3A or FIG. 3B again, the light-emitting diode light string 30 can be coupled to the voltage adjustment capacitor (the voltage adjustment unit 24) in parallel as well. Namely, an external capacitor is coupled between the anode side and the cathode side of the light-emitting diode light string 30, to increase the equivalent total capacitance of the circuit of the light-emitting diode light string 30, so that the reducing speed of the light drive signal Vd becomes slow, to avoid touching the reset voltage Vreset, happening unnecessary reset malfunction for the circuit, and resulting in abnormal determination and malfunction of the light-emitting diode module 31. Incidentally, for the control of the light-emitting diode module 31, the normal control is a third waveform Cv3 shown in FIG. 6. Namely, the present invention can operate continuously in the condition that: the light control signal can be normally recognized/identified as the low level but does not touch the reset voltage Vreset, even does not touch the reference voltage value Vth, to maintain the light control unit 311, the address signal processing unit 312 and the address burn unit 313 do not enter the sleep mode, to achieve the best control efficiency. In other words, by the designs of the circuit parameters and the clocks, the width between two cycles are adjusted, for examples, shortening the width and/or cooperating with a rapid discharge circuit. Such control method can be applied to both: more numbers of lights in series and fast identification/recognition for the light control signal which is the low-level voltage; the best control efficiency without entering the sleep mode can be maintained as well.

Figure 7A:
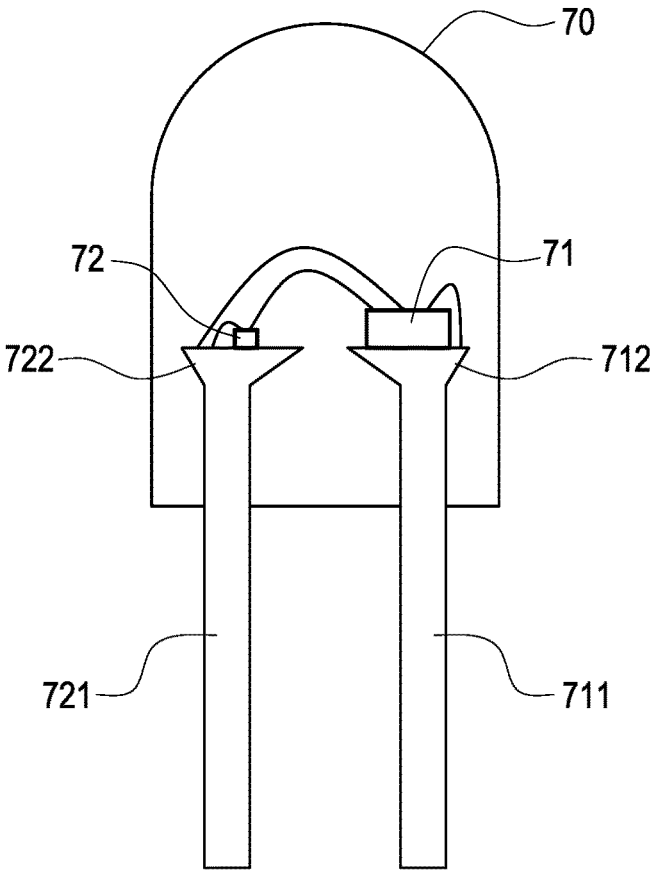
FIG. 7A shows a perspective drawing of the first embodiment of the package structure of the light-emitting diode light of the present invention.
Figure 7B:
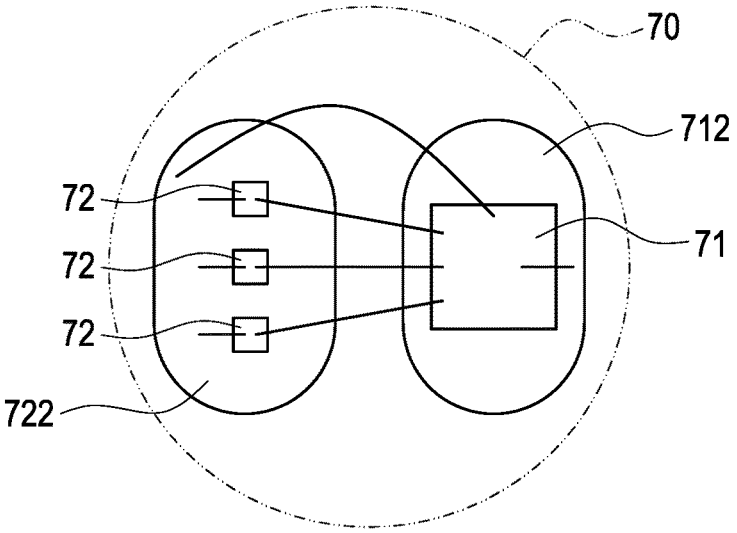
FIG. 7B shows a top view of the first embodiment of the package structure of the light-emitting diode light of the present invention.

FIG. 7A shows a perspective drawing of the first embodiment of the package structure of the light-emitting diode light of the present invention. FIG. 7B shows a top view of the first embodiment of the package structure of the light-emitting diode light of the present invention. Any one of the light-emitting diode modules 31, 32 . . . 3*n* mentioned above is packaged inside a package body 70 to form the package structure, which comprises the drive unit 71 and at least one light-emitting diode 72; in this embodiment, there are three light-emitting diodes which are R (red), G (green) and B (blue), but the present invention is not limited by it. The package structure further comprises a first support 711, a first platform 712 which is formed on the first support 711, a second support 721, and a second platform 722 which is formed on the second support 721. The drive unit 71 is arranged on the first platform 712 and is electrically connected to the first platform 712 by the wire bonding method. The light-emitting diode 72 is arranged on the second platform 722 and is electrically connected to the second platform 722 by the wire bonding method. The drive unit 71 is electrically connected to the light-emitting diode 72. For example, the drive unit 71 is electrically connected to the light-emitting diode 72 by the wire bonding method, to proceed to drive and control the light-emitting diode 72.

Figure 8A:
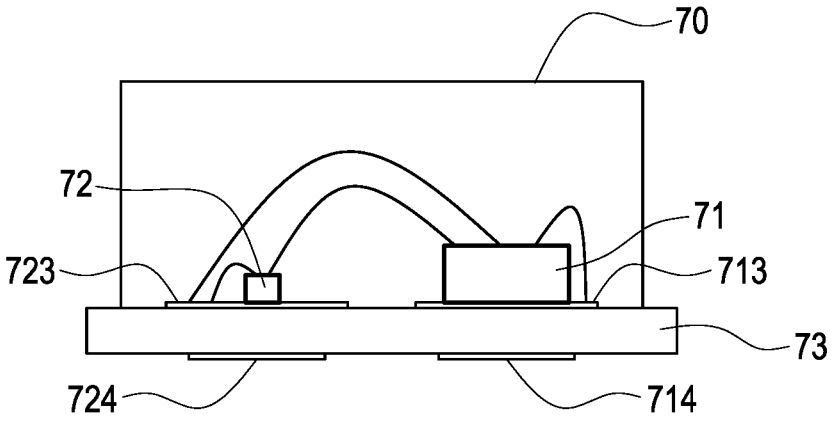
FIG. 8A shows a perspective drawing of the second embodiment of the package structure of the light-emitting diode light of the present invention.
Figure 8B:
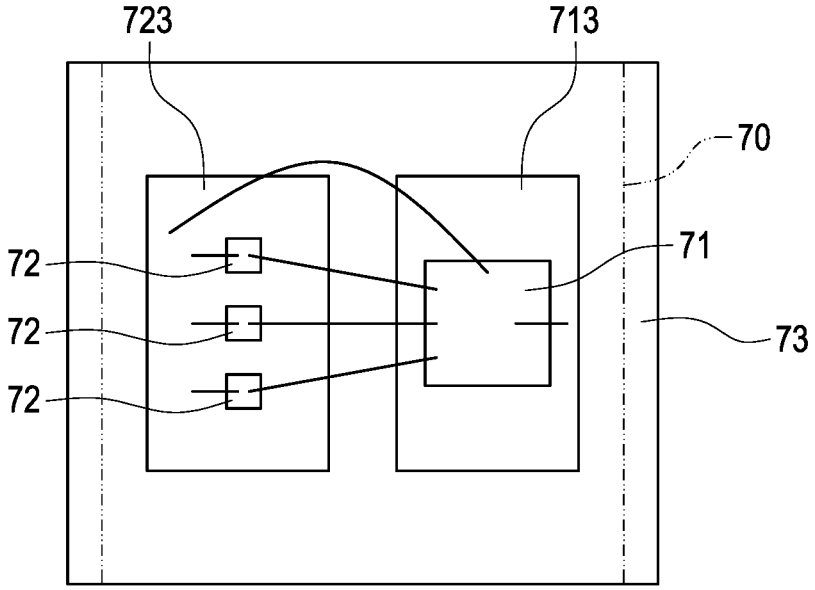
FIG. 8B shows a top view of the second embodiment of the package structure of the light-emitting diode light of the present invention.

FIG. 8A shows a perspective drawing of the second embodiment of the package structure of the light-emitting diode light of the present invention. FIG. 8B shows a top view of the second embodiment of the package structure of the light-emitting diode light of the present invention. Compared to the contents shown in FIG. 7A, the package structure shown in FIG. 8A utilizes the surface mount device (SMD) form. The drive unit 71 is arranged on a first soldering block 713 and is electrically connected to the first soldering block 713 by the wire bonding method. The at least one light-emitting diode 72 is arranged on a second soldering block 723 and is electrically connected to the second soldering block 723 by the wire bonding method; in this embodiment, there are three light-emitting diodes which are R (red), G (green) and B (blue), but the present invention is not limited by it. The drive unit 71 is electrically connected to the light-emitting diode 72 by the wire bonding method, to proceed to drive and control the light-emitting diode 72. The first soldering block 713 and the second soldering block 723 are arranged on the baseboard 73. The first soldering block 713 (which is arranged on one side of the baseboard 73) and a first electrode 714 (which is arranged on the other side of the baseboard 73) form an electrical connection (namely, the first soldering block 713 is electrically connected to the first electrode 714) by filling at least one first via hole of/on the baseboard 73 with a first conducting material (for example, a conducting tin). Similarly, the second soldering block 723 (which is arranged on one side of the baseboard 73) and a second electrode 724 (which is arranged on the other side of the baseboard 73) form an electrical connection (namely, the second soldering block 723 is electrically connected to the second electrode 724) by filling at least one second via hole of/on the baseboard 73 with a second conducting material (for example, a conducting tin). Finally, another embodiment/method of the package structure of any one of the light-emitting diode modules 31, 32 . . . 3*n* mentioned above is achieved/realized by the package body 70 for proceeding the package.

In conclusion, the present invention comprises following features and advantages:

1. The efficiency of sending the light drive signal and the supplied power to the light-emitting diode light string under/with/by the same circuit structure can be achieved/realized.

2. Rapid discharge is provided to control the voltage level of the light drive signal to be reduced rapidly by the rapid discharge circuit of each of the light-emitting diode modules, so that all of the light-emitting diodes in series are ensured to obtain the complete light control.

3. The power consumption of the analog circuits of the light-emitting diode module is reduced effectively; maintaining the light-emitting diode module to be able to be driven and operated normally can be taken into account at the same time.

4. The light-emitting diode module can utilize the point-control operating method, or can utilize the synchronous operating method as well. Not only the flexibility and the convenience of the control circuit design can be increased/improved, but also various lighting output effects and changes of the light-emitting diode lamp can be achieved at the same time.

The contents mentioned above are just the detailed descriptions and figures of the preferred embodiments of the present invention. The features of the present invention are not limited by them, and they are not used to limit the present invention. All scope of the present invention should be defined in the appended claims. Embodiments having the spirit or the spirit with similar changes of the claims of the present invention should be included in the scope of the present invention. Changes or modifications easily thought by any technician familiar with the art in the field of the present invention can be included in the appended claims.

What is claimed is:

1. A carrier-controlled light-emitting diode light comprising:

at least one light-emitting diode; and a drive unit coupled to the at least one light-emitting diode, the drive unit configured to receive a carrier light signal to control the at least one light-emitting diode to proceed to light, the drive unit comprising:

a light control unit configured to drive a light action of the at least one light-emitting diode based on a light command content of the carrier light signal; and a comparison unit configured to receive a direct current working electricity and configured to compare the direct current working electricity with a reference voltage value, wherein when a voltage value of the direct current working electricity is greater than the reference voltage value, the comparison unit is configured to output a first control signal based on the light command content of the carrier light signal, so that the light control unit is configured to enter a work mode; when the voltage value of the direct current working electricity is less than the reference voltage value, the comparison unit is configured to output a second control signal to the light control unit, so that the light control unit is configured to enter a sleep mode; the reference voltage value is greater than a reset voltage value of the drive unit.

2. The carrier-controlled light-emitting diode light in claim 1, wherein the drive unit further comprises:

an address signal processing unit coupled to the light control unit and the comparison unit, wherein the address signal processing unit is configured to store a light address; the address signal processing unit is configured to receive an address signal sent from the light control unit to compare the address signal with the light address; when the address signal conforms to the light address, the light control unit is configured to drive the at least one light-emitting diode to light based on the light command content of the carrier light signal; when the comparison unit outputs the second control signal to the address signal processing unit, the address signal processing unit is configured to enter the sleep mode until the address signal processing unit receives the first control signal; after the address signal processing unit receives the first control signal, the address signal processing unit is configured to enter the work mode.

3. The carrier-controlled light-emitting diode light in claim 2, wherein the drive unit further comprises:

an address burn unit coupled to the address signal processing unit and the comparison unit, wherein the carrier light signal comprises a burn start signal and a burn address signal; when the address burn unit receives the burn start signal, the address burn unit is configured to write the light address into the address signal processing unit based on a burn command content of the burn address signal; when the comparison unit outputs the second control signal to the address burn unit, the address burn unit is configured to enter the sleep mode until the address burn unit receives the first control signal; after the address burn unit receives the first control signal, the address burn unit is configured to enter the work mode.

4. The carrier-controlled light-emitting diode light in claim 3, wherein the drive unit further comprises:

an oscillator coupled to the light control unit, the address signal processing unit, the address burn unit and the comparison unit, wherein when the comparison unit outputs the second control signal to the oscillator, the oscillator is configured to enter the sleep mode to stop an oscillating work until the oscillator receives the first control signal; after the oscillator receives the first control signal, the oscillator is configured to enter the work mode to start the oscillating work to provide an oscillation signal; when the oscillator is in the sleep mode and stops the oscillating work, the light control unit, the address signal processing unit and the address burn unit do not receive the oscillation signal provided by the oscillator, so the light control unit, the address signal processing unit and the address burn unit are configured to enter the sleep mode.

5. The carrier-controlled light-emitting diode light in claim 1, wherein the drive unit further comprises:

a current detection unit coupled to the light control unit, wherein after the light control unit receives the light command content of the carrier light signal through the current detection unit, the light control unit is configured to drive the light action of the at least one light-emitting diode.

6. The carrier-controlled light-emitting diode light in claim 5, wherein the drive unit further comprises:

a discharge unit coupled to the comparison unit and the current detection unit, wherein when the discharge unit receives the carrier light signal sent by the current detection unit, the discharge unit is configured to start discharging the direct current working electricity.

7. The carrier-controlled light-emitting diode light in claim 1, wherein the drive unit further comprises:

a power capacitor coupled to the light control unit, the comparison unit and the at least one light-emitting diode.

8. The carrier-controlled light-emitting diode light in claim 1, wherein the at least one light-emitting diode and the drive unit are arranged on a baseboard with a surface mount device form; the drive unit and the at least one light-emitting diode are electrically connected by a wire bonding method and are packaged inside a package body.

9. The carrier-controlled light-emitting diode light in claim 1, wherein the drive unit is electrically connected to and arranged on a first platform; the at least one light-emitting diode is electrically connected to and arranged on a second platform; the drive unit and the at least one light-emitting diode are electrically connected by a wire bonding method and are packaged inside a package body.

10. A carrier-controlled light-emitting diode light string comprising:

a power line;

a controller coupled to the power line; and at least one light-emitting diode light, each the at least one light-emitting diode light comprising:

at least one light-emitting diode; and a drive unit coupled to the at least one light-emitting diode, the drive unit configured to receive a carrier light signal to control the at least one light-emitting diode to proceed to light, the drive unit comprising:

a light control unit configured to drive a light action of the at least one light-emitting diode based on a light command content of the carrier light signal; and a comparison unit configured to receive a direct current working electricity and configured to compare the direct current working electricity with a reference voltage value, wherein when a voltage value of the direct current working electricity is greater than the reference voltage value, the comparison unit is configured to output a first control signal based on the light command content of the carrier light signal, so that the light control unit is configured to enter a work mode; when the voltage value of the direct current working electricity is less than the reference voltage value, the comparison unit is configured to output a second control signal to the light control unit, so that the light control unit is configured to enter a sleep mode; the reference voltage value is greater than a reset voltage value of the drive unit; the at least one light-emitting diode light is coupled to the controller through the power line, and is configured to receive the direct current working electricity and the carrier light signal sent by the controller through the power line.

11. The carrier-controlled light-emitting diode light string in claim 10, wherein the controller comprises:

a rectification unit coupled to the power line, and configured to provide the direct current working electricity;

a switch connected to the power line and the at least one light-emitting diode light; and a control unit coupled to the rectification unit and the switch, wherein when the control unit controls the switch to be turned on, the direct current working electricity is through the power line to form a power supply circuit for supplying power to the at least one light-emitting diode light;

wherein when the control unit intends to generate the carrier light signal, the control unit is configured to switch a conduction and a cut-off of the switch continuously based on the light command content of the carrier light signal, so that the direct current working electricity of the power line forms a plurality of pulse waves to combine into the carrier light signal, and the carrier light signal is sent to the at least one light-emitting diode light through the power line.

12. The carrier-controlled light-emitting diode light string in claim 11, wherein the controller further comprises:

a discharge circuit coupled to the power line and the control unit, wherein when the switch is turned off, the controller is configured to drive the discharge circuit to receive the direct current working electricity and to start discharging the direct current working electricity.

13. The carrier-controlled light-emitting diode light string in claim 11, wherein the controller further comprises:

a voltage adjustment capacitor coupled to the power line, wherein when the switch is turned off, the voltage adjustment capacitor is configured to provide the at least one light-emitting diode light with the direct current working electricity.

* * * * *